US011028740B2

(12) United States Patent
Koyama

(10) Patent No.: US 11,028,740 B2
(45) Date of Patent: Jun. 8, 2021

(54) LUBRICATING OIL SUPPLY STRUCTURE

(71) Applicant: TOYOTA JIDOSHA KABUSHIKI KAISHA, Toyota (JP)

(72) Inventor: Takashi Koyama, Mishima (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/783,245

(22) Filed: Feb. 6, 2020

(65) Prior Publication Data

US 2020/0291834 A1 Sep. 17, 2020

(30) Foreign Application Priority Data

Mar. 15, 2019 (JP) ..... JP2019-049042

(51) Int. Cl.

| | |
|---|---|
| ***F01L 1/344*** | (2006.01) |
| ***F01M 9/10*** | (2006.01) |
| ***F01M 11/02*** | (2006.01) |
| ***F02F 7/00*** | (2006.01) |
| ***F01L 1/047*** | (2006.01) |
| *F01M 1/02* | (2006.01) |
| *F01M 1/12* | (2006.01) |

(52) U.S. Cl.

CPC ..... *F01M 9/102* (2013.01); *F01L 1/047* (2013.01); *F01M 9/101* (2013.01); *F01M 9/105* (2013.01); *F01M 11/02* (2013.01); *F02F 7/0053* (2013.01); *F01L 2001/0476* (2013.01); *F01M 1/02* (2013.01); *F01M 1/12* (2013.01); *F01M 2011/026* (2013.01)

(58) Field of Classification Search

CPC ..... F01M 9/102; F01M 9/101; F01M 9/105; F01M 11/02; F01M 1/02; F01M 1/12; F01M 2011/026; F02F 7/0053; F01L 1/047; F01L 2001/0476

See application file for complete search history.

(56) References Cited

U.S. PATENT DOCUMENTS

2008/0110332 A1* 5/2008 Yi ..... F01M 9/102 92/163

FOREIGN PATENT DOCUMENTS

| | | |
|---|---|---|
| JP | 2010-164009 A | 7/2010 |
| JP | 2010-174803 A | 8/2010 |

* cited by examiner

*Primary Examiner* — Zelalem Eshete

(74) *Attorney, Agent, or Firm* — Oblon, McClelland, Maier & Neustadt, L.L.P.

(57) ABSTRACT

A lubricating oil supply structure includes: a shaft; a bearing supporting the shaft and having an oil supply port, through which lubricating oil is supplied to between the shaft and the bearing, and an oil introduction port, through which the lubricating oil is introduced; a first oil passage, connected to the oil supply port, distributing the lubricating oil from an oil pump toward the oil supply port; a second oil passage, connected to the oil introduction port, supplying the lubricating oil introduced through the oil introduction port to a supply destination; a connection oil passage, formed by a gap between the bearing and the shaft, connecting between the first oil passage and the second oil passage, and a throttle portion, formed on a part of the connection oil passage, suppressing a flow of the lubricating oil from the oil supply port toward the oil introduction port.

10 Claims, 7 Drawing Sheets

LUBRICATING OIL SUPPLY STRUCTURE

CROSS-REFERENCE TO RELATED APPLICATION(S)

The present application claims priority to and incorporates by reference the entire contents of Japanese Patent Application No. 2019-049042 filed in Japan on Mar. 15, 2019.

BACKGROUND

The present disclosure relates to a lubricating oil supply structure.

From the viewpoint of preventing foreign matter clogging, it has been known that an oil passage for supplying lubricating oil cannot usually be smaller than approximately ϕ1.2 to 1.5 mm. In this case, if a diameter of the oil passage increases to prevent foreign matter clogging, since portions (lubrication-necessary portions) with no sliding problem even with a small amount of lubricating oil are supplied with more lubricating oil than necessary, there is a risk that a capacity of an oil pump increases, a mechanical loss increases, and fuel efficiency deteriorates. Therefore, it is desirable to reduce the amount of lubricating oil supplied depending on the amount required for destinations (lubrication-necessary portions) to be supplied with lubricating oil.

Japanese Laid-open Patent Publication No. 2010-174803 discloses that a first oil passage, a second oil passage, and a third oil passage through which lubricating oil is supplied from an oil pump to an oil filter are connected to a downstream side of the oil filter so that cross-sectional areas of the oil passages are gradually reduced.

In the configuration described in Japanese Laid-open Patent Publication No. 2010-174803, three hole shapes need to be fabricated corresponding to each of the first to third oil passages, and therefore processing costs are required, and all the first oil passage, the second oil passage, and the third oil passage extend in different directions, and therefore a space is required to install the oil passages and a structure becomes complicated.

SUMMARY

There is a need for providing a lubricating oil supply structure capable of reducing a flow rate of lubricating oil supplied to lubrication-necessary portions while suppressing foreign matter clogging with a simple structure.

According to an embodiment, A lubricating oil supply structure, includes: a shaft; a bearing, which supports the shaft and has an oil supply port, through which a lubricating oil is supplied to between the shaft and the bearing, and an oil introduction port, through which the lubricating oil between the shaft and the bearing is introduced; a first oil passage, which is connected to the oil supply port and distributes the lubricating oil from an oil pump toward the oil supply port; a second oil passage, which is connected to the oil introduction port and supplies the lubricating oil introduced through the oil introduction port to a supply destination other than the bearing; a connection oil passage, which is formed by a gap between the bearing and the shaft and connects between the first oil passage and the second oil passage, and a throttle portion, formed on a part of the connection oil passage, to suppress a flow of the lubricating oil from the oil supply port toward the oil introduction port.

DETAILED DESCRIPTION

Hereinafter, a lubricating oil supply structure according to embodiments of the present disclosure will be described in detail with reference to the drawings. Note that the present disclosure is not limited to embodiments described below.

First Embodiment

Figure 1:
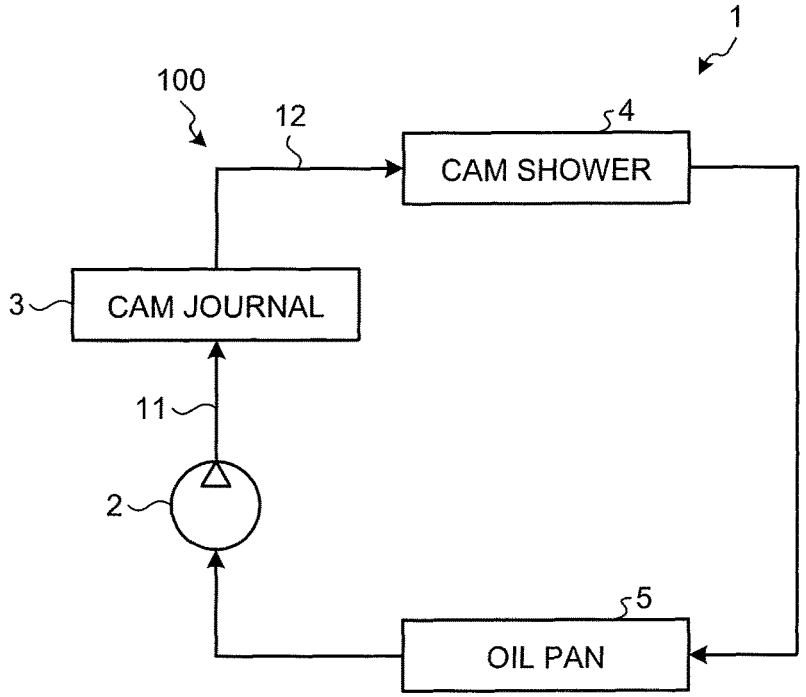
FIG. 1 is a configuration diagram illustrating a case where a lubricating oil supply structure according to a first embodiment is applied to a lubricating device of an internal combustion engine.
Figure 2:
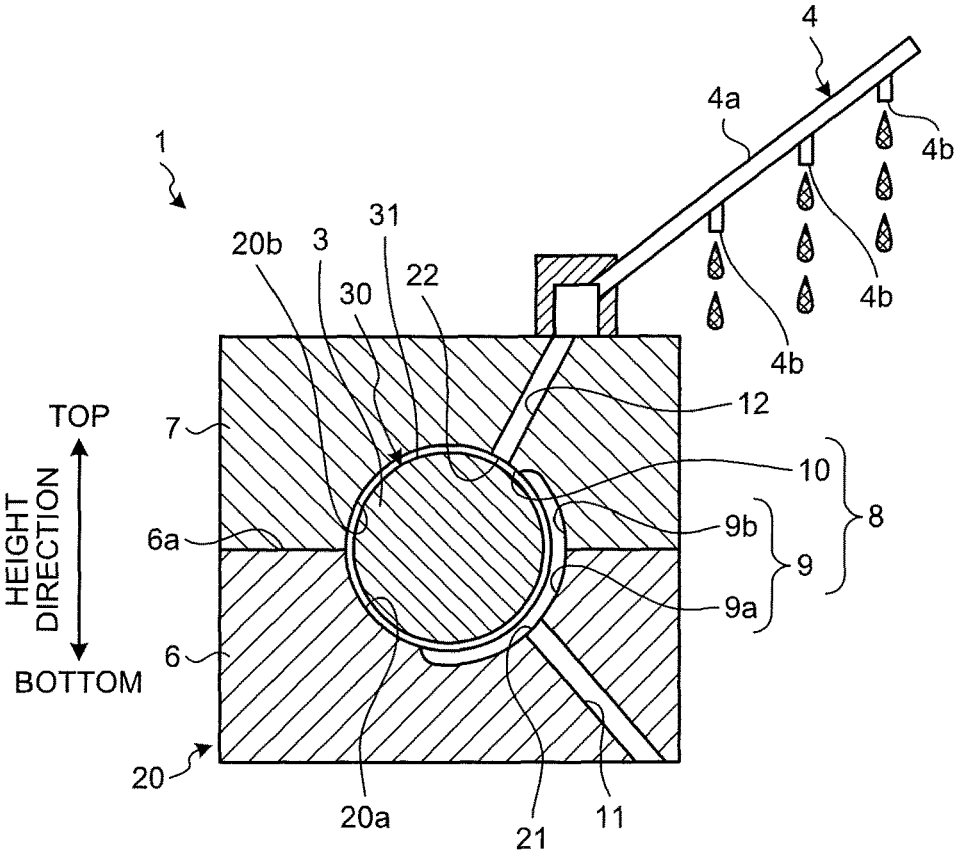
FIG. 2 is a diagram schematically illustrating a configuration of the lubricating oil supply structure according to the first embodiment.

FIG. 1 is a configuration diagram illustrating a case where a lubricating oil supply structure according to the first embodiment is applied to a lubricating device of an internal combustion engine. FIG. 2 is a diagram schematically illustrating a configuration of the lubricating oil supply structure according to the first embodiment.

A lubricating oil supply structure 1 according to the first embodiment can be applied to a lubricating device 100 of an internal combustion engine. As illustrated in FIG. 1, the lubricating device 100 of the internal combustion engine is a device that circulates lubricating oil by an oil pump 2 and supplies the lubricating oil to a cam journal 3 and a cam shower 4. A lubricating oil supply destination includes the cam journal 3 and the cam shower 4. In this circulation route, the cam shower 4 is disposed on a downstream side of the cam journal 3. The cam shower 4 is a portion that requires a small amount of lubricating oil.

The oil pump 2 sucks lubricating oil stored in an oil pan 5 and discharges the lubricating oil to a first oil passage 11 which is a supply oil passage. The first oil passage 11 is an oil passage through which the lubricating oil supplied from the oil pump 2 is distributed (supplied) toward the cam journal 3 of a camshaft 30. The lubricating oil is supplied from the first oil passage 11 to the cam journal 3. The lubricating oil supplied to the cam journal 3 lubricates the cam journal 3 and then is supplied to the cam shower 4. The cam shower 4 drops the lubricating oil onto a cam lobe (not illustrated) of the camshaft 30. The lubricating oil dropped from the cam shower 4 is supplied to the cam lobe above a cylinder head 6 and then stored in the oil pan 5 provided under the internal combustion engine. When the oil pump 2 is driven, the lubricating oil stored in the oil pan 5 is sucked from a suction port of the oil pump 2 through a strainer (not illustrated) and discharged from a discharge port to the supply oil passage. Note that an oil filter (not illustrated) may be provided between the oil pump 2 and the cam journal 3.

The camshaft 30 includes the cam journal 3 and the cam lobe. The cam journal 3 is a portion supported by a bearing 20. The cam lobe is a portion that slides on a rocker arm (not illustrated), and a plurality of cam lobes are provided on the camshaft 30. In addition, the internal combustion engine is provided with two camshafts, an intake valve camshaft and an exhaust valve camshaft. Note that in this description, the camshaft 30 is described without particularly distinguishing between the intake valve camshaft and the exhaust valve camshaft.

As illustrated in FIG. 2, a cam cap 7 is fixed to an upper surface 6*a* of the cylinder head 6 of the internal combustion engine. The camshaft 30 is rotatably supported by the cylinder head 6 and the cam cap 7. The bearing 20 of the camshaft 30 is configured to include the cylinder head 6 and the cam cap 7. The cylinder head 6 constitutes a lower bearing. The cam cap 7 constitutes an upper bearing. Note that in this description, the cylinder head 6 and the cam cap 7 may be collectively referred to as the bearing 20. Further, when describing a structure around the bearing 20, the cam journal 3 and the camshaft 30 are synonymous.

The lubricating oil supply structure 1 according to the first embodiment is a structure provided around the camshaft 30 and includes a connection oil passage 8 formed by a gap between the camshaft 30 and the bearing 20. The connection oil passage 8 is an oil passage formed by a surface of the lubrication-necessary portion and constitutes a flow path that connects between the first oil passage 11 and a second oil passage 12. The lubricating oil is supplied to the cam shower 4 via this connection oil passage 8. Specifically, a route through which the lubricating oil flows is formed in the order of a first oil passage 11, an oil outlet port (oil supply port) 21, a connection oil passage 8, an inlet port (oil introduction port) 22, a second oil passage 12, and the cam shower 4 from an upstream side toward a downstream side.

The first oil passage 11 is an oil passage formed in the cylinder head 6, and the downstream side is connected to the oil outlet port 21. The oil outlet port 21 is an opening formed in the cylinder head 6 and supplies the lubricating oil pumped from the first oil passage 11 to the gap between the camshaft 30 and the bearing 20.

An oil groove 9*a* extending in a circumferential direction is formed on a bearing surface 20*a* of the cylinder head 6 which is a lower bearing. Similarly, an oil groove 9*b* extending in the circumferential direction is formed on a bearing surface 20*b* of the cam cap 7 which is an upper bearing. The oil groove 9*a* of the cylinder head 6 and the oil groove 9*b* of the cam cap 7 are formed in series. The oil groove 9 as a whole has a structure which is not formed on the entire circumference in the circumferential direction but partly extends in the circumferential direction. The oil outlet port 21 is opened (formed) in the oil groove 9*a* provided on the bearing surface 20*a* of the cylinder head 6. The lubricating oil is supplied from the oil outlet port 21 to the inside of the oil groove 9.

The connection oil passage 8 is an oil passage through which lubricating oil is distributed between the oil outlet port 21 and the inlet port 22, and is an oil passage that connects between the first oil passage 11 and the second oil passage 12. The connection oil passage 8 is configured to include the oil groove 9 and the throttle portion 10. The oil passage formed by the oil groove 9 is an oil passage formed by a gap between a bottom surface of the oil groove 9 and an outer circumferential surface 31 of the cam journal 3. The throttle portion 10 is disposed at a position between the inlet port 22 and the oil groove 9 in the circumferential direction of the bearing 20. That is, the oil outlet port 21 and the inlet port 22 are disposed at a position where axial positions overlap and circumferential positions are different.

The throttle portion 10 is an oil passage formed by a gap between the bearing surface 20*b* of the cam cap 7 which is the upper bearing and the outer circumferential surface 31 of the cam journal 3. The throttle portion 10 has a structure that suppresses a distribution (flow) of lubricating oil flowing from the oil outlet port 21 into the inlet port 22. As illustrated in FIG. 2, a radial gap formed by the throttle portion 10 is formed to be narrower than a radial gap formed by the oil groove 9. Therefore, the throttle portion 10 functions as a portion where a cross-sectional area of the oil passage is more reduced and a flow rate of lubricating oil is more reduced, as compared with the portion where the oil groove 9 is provided.

Further, since the connection oil passage 8 is formed by a gap between the bearing surface 20*b* and the shaft surface, the connection oil passage 8 has a foreign matter discharging and embedding function. Therefore, when diameters of the first oil passage 11 and the second oil passage 12 are formed to be approximately $\phi$1.2 to 1.5 mm capable of suppressing foreign matter clogging, the throttle portion 10 provided in the connection oil passage 8 is formed in a flow path (narrow flow path) narrower than the minimum diameter of 1.2 mm. For example, the throttle portion 10 is an oil passage formed by a gap of several tens of μm.

The inlet port 22 is an opening through which lubricating oil existing between the outer circumferential surface 31 of the cam journal 3 and the bearing surface of the bearing 20 is introduced into the second oil passage 12. The inlet port 22 is opened (formed) on the bearing surface 20*b* of the cam cap 7. More specifically, the inlet port 22 is opened in the portion of the bearing surface 20*b* of the cam cap 7 where the oil groove 9*b* is not formed. This inlet port 22 enables lubricating oil to be distributed toward a supply destination different from the cam journal 3.

The second oil passage 12 is an oil passage formed in the cam cap 7, and the upstream side thereof is connected to the inlet port 22. A cam shower pipe 4*a* which forms the cam shower 4 is connected to the downstream side of the second oil passage 12. The cam shower pipe 4*a* is disposed above the cam cap 7. The cam shower 4 is provided with a plurality of supply ports 4*b* through which lubricating oil is dropped. The supply port 4*b* is disposed above the cam lobe of the camshaft 30 and opens downward. The lubricating oil introduced into the second oil passage 12 from the inlet port 22 distributes upward in the cam cap 7 and is supplied to the cam shower 4. The lubricating oil supplied to the cam shower 4 is dropped from the supply port 4*b* and supplied to the cam lobe of the camshaft 30.

As described above, in the first embodiment, the lubricating oil can be supplied to the cam shower 4 via the connection oil passage 8 formed by the gap between the bearing surface of the bearing 20 and the outer circumferential surface 31 of the cam journal 3. Further, since the gap between the bearing 20 and the camshaft 30 has the foreign matter discharging and embedding function, the foreign matter clogging can be suppressed even in the narrow flow path, unlike a related-art oil passage. Therefore, it is possible to reduce the flow rate of lubricating oil supplied to the cam shower 4, which is a supply destination requiring a small amount of lubricating oil, by providing the throttle portion 10 in the connection oil passage 8.

In addition, in the first embodiment, the connection oil passage 8 formed by the gap between the bearing 20 and the cam journal 3 is provided on the upstream side of the cam shower 4, and the throttle portion 10 may be formed in a part of the connection oil passage 8. Therefore, compared to the structure that forms a plurality of oil passages having different cross-sectional areas as in the related-art structure, according to the first embodiment, the structure is simple, and the flow rate of the lubricating oil can be reduced while suppressing the foreign matter clogging.

In addition, another related-art structure includes a structure in which the inlet port 22 of the second oil passage 12 is provided in the oil groove 9*b* of the cam cap 7. Compared with the related-art structure, in the first embodiment, the position where the inlet port 22 is provided is only changed from the inside of the oil groove 9*b* to the portion where the oil groove 9*b* is not provided, so that the manufacturing cost can be suppressed.

In addition, since the flow of the lubricating oil can be suppressed by the throttle portion 10 and the minimum required lubricating oil can be supplied to the cam shower 4, the capacity of the oil pump 2 can be reduced and unnecessary work can be reduced. As a result, the fuel efficiency of the internal combustion engine is improved. In addition, when the lubricating oil is supplied more than necessary, a bubble rate in oil due to oil agitation increases, but in the first embodiment, unnecessary oil supply is suppressed, so the flow rate of the lubricating oil can be reduced and the bubble rate in the oil can be reduced. Therefore, according to the first embodiment, the surplus of the oil pump capability can be reduced depending on a decrease in a supply pressure to a hydraulic device due to air bubbles, and the capacity of the oil pump 2 can be further reduced.

Note that in the first embodiment, the structure in which the connection oil passage 8 includes the oil groove 9 has been described, but the present disclosure is not limited thereto. That is, the connection oil passage 8 may have a structure including the throttle portion 10 formed by the gap between the bearing surface and the outer circumferential surface of the shaft, and may not necessarily include the oil groove 9. In short, the oil passage structure that passes through the bearing 20 which is a portion having the foreign matter discharging and embedding function may be the lubricating oil supply structure 1 including the connection oil passage 8 in which the oil groove 9 is not provided.

In addition, in the first embodiment, the example in which the lubricating oil supply structure is applied to the lubricating device 100 of the internal combustion engine has been described, but the present disclosure is not limited thereto. In other words, the device that supplies the lubricating oil to the plurality of supply destinations by one oil pump may have the structure in which the connection oil passage 8 including the shaft and the bearing may be provided in the middle of a route for supplying lubricating oil to the portion where the amount of lubricating oil required for lubrication is relatively small.

Modification of First Embodiment

A modification of the first embodiment will be described with reference to FIGS. 3 to 7. A lubricating oil supply structure 1A in this modification has a structure in which an oil groove is provided on a camshaft 30 side.

Figure 3:
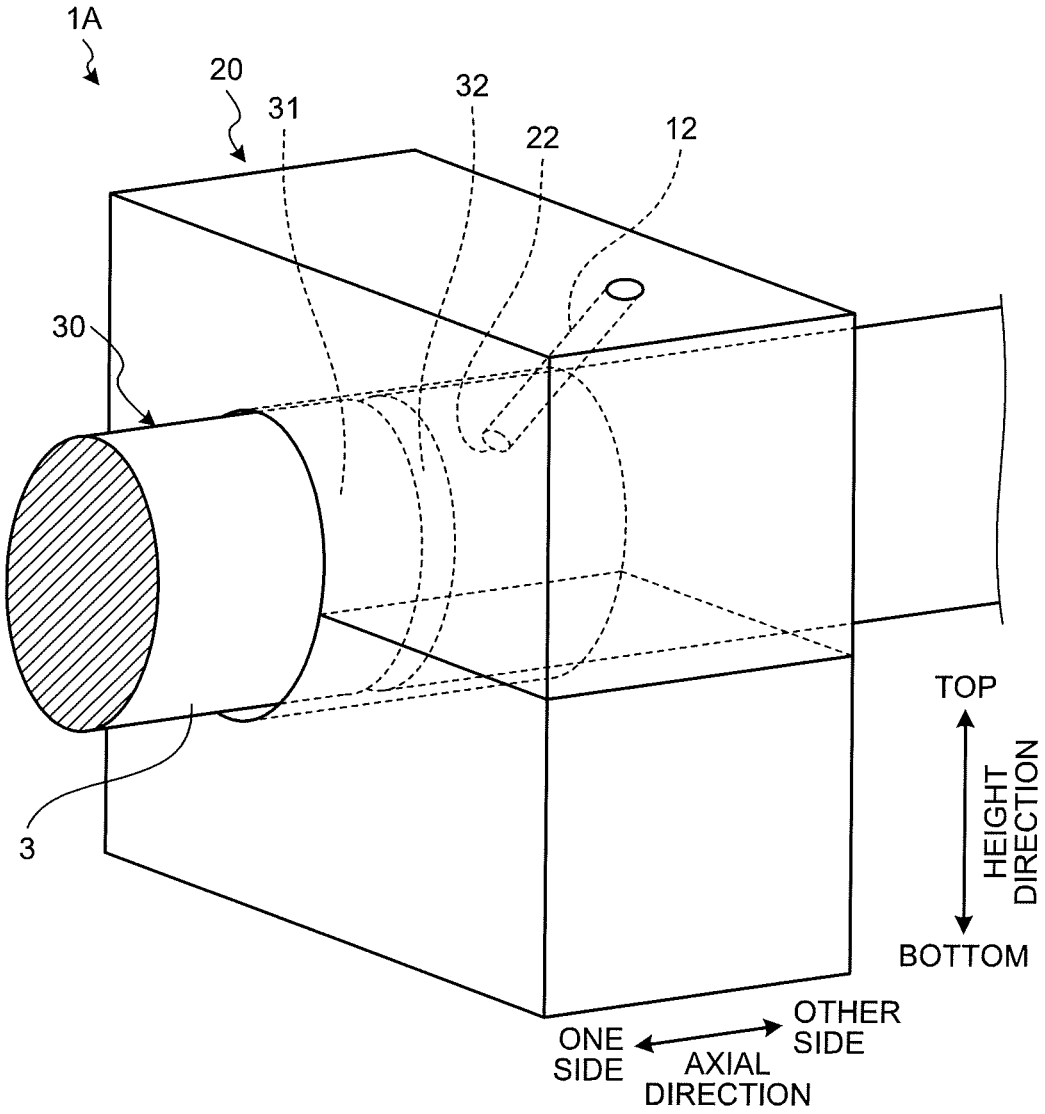
FIG. 3 is a perspective view schematically illustrating a modification of the first embodiment.
Figure 4:
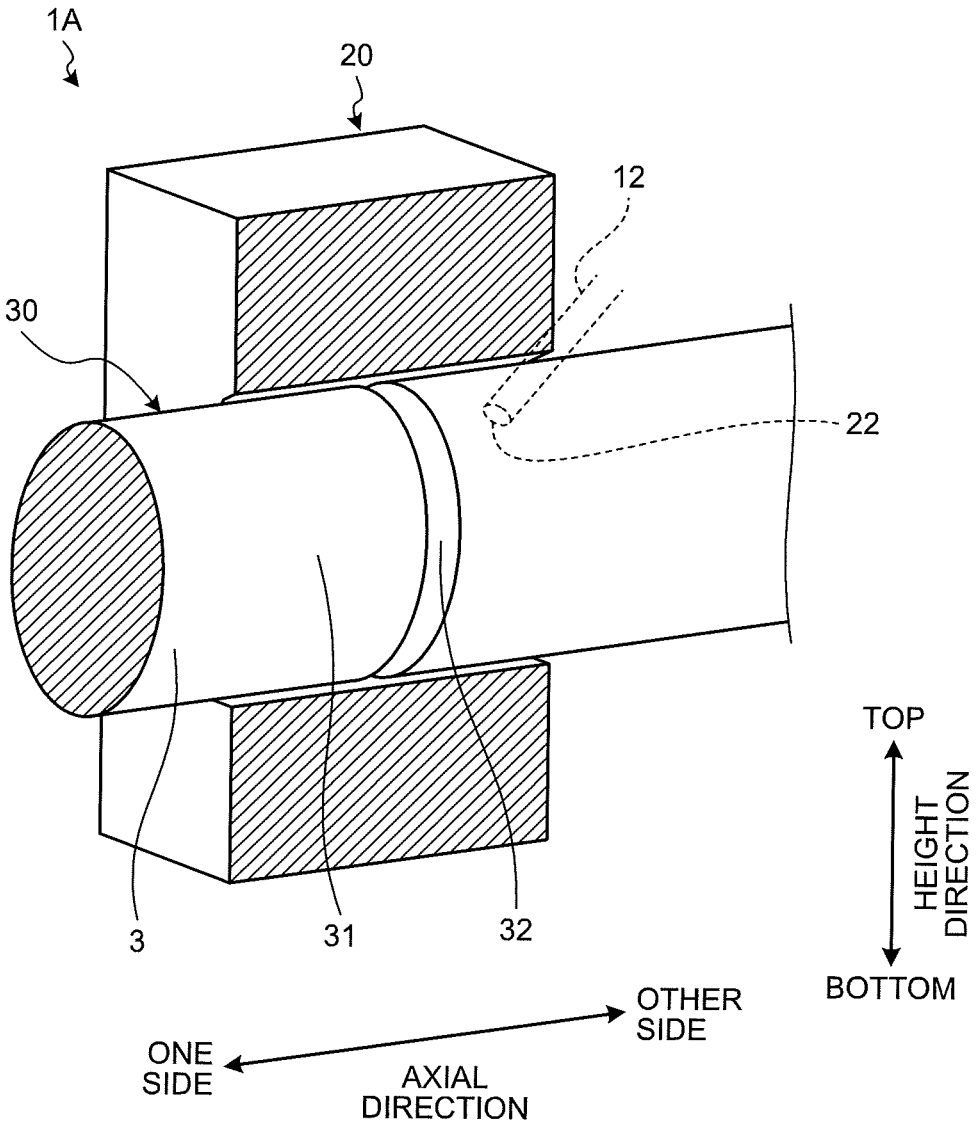
FIG. 4 is a partial cross-sectional view schematically illustrating the modification of the first embodiment.

As illustrated in FIGS. 3 and 4, in this modification, an oil groove 32 extending along a circumferential direction is formed on an outer circumferential surface 31 of a cam journal 3. The oil groove 32 is an annular groove formed over the entire circumference of the outer circumferential surface 31. An inlet port 22 is disposed at a position different from an axial position where the oil groove 32 is provided. As a result, a throttle portion 10A (illustrated in FIG. 6) extending in an axial direction can be formed between the oil groove 32 and the inlet port 22.

Figure 5:
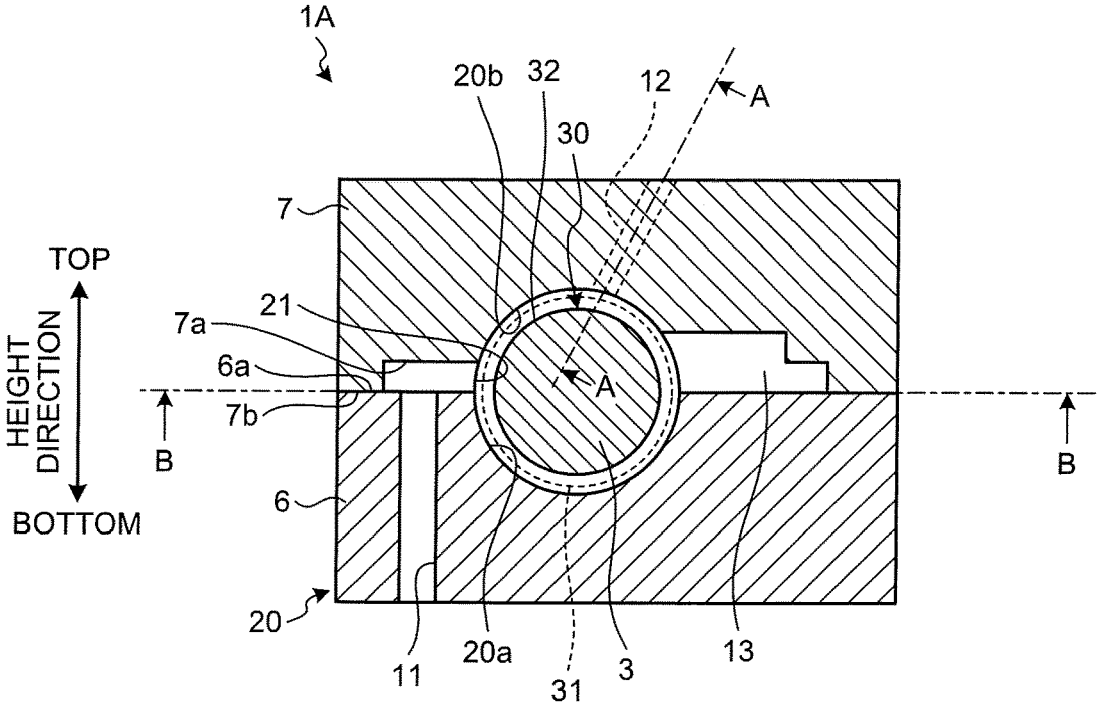
FIG. 5 is a diagram schematically illustrating a configuration of the lubricating oil supply structure according to a modification of the first embodiment.
Figure 7:
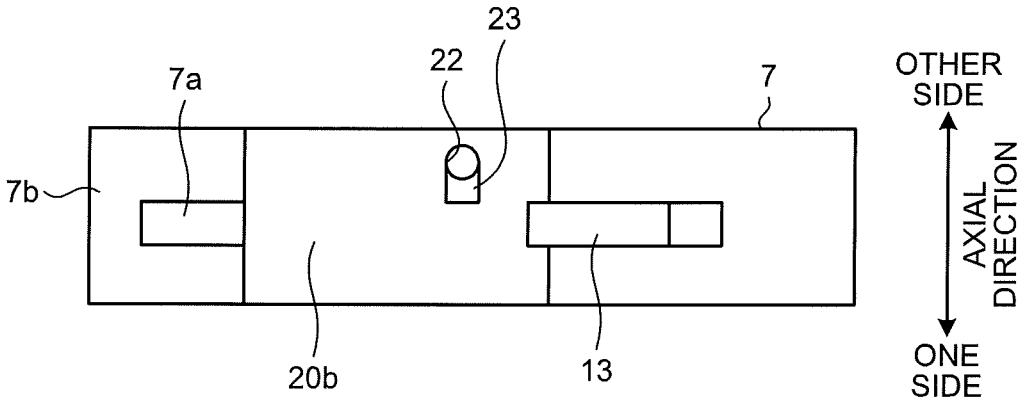
FIG. 7 is a schematic diagram illustrating a structure of a cam cap as viewed from the arrow B in FIG. 5.

As illustrated in FIG. 5, an oil outlet port 21 is opened (formed) on a bearing surface 20*b* of a cam cap 7. A portion where the oil outlet port 21 is opened is a position of the bearing surface 20*b* facing the oil groove 32 of the cam journal 3 in a radial direction. That is, the oil outlet port 21 of the cam cap 7 is provided at a position where the axial position overlaps with the oil groove 32 of the cam journal 3. As a result, the oil outlet port 21 is opened toward the oil groove 32. In addition, the first oil passage 11 has a structure in which an oil passage formed in a cylinder head 6 and an oil passage 7*a* formed in the cam cap 7 communicate with each other. The oil passage 7*a* is a linear groove formed on a lower surface 7*b* of the cam cap 7, as illustrated in FIG. 7 and the like.

Figure 6:
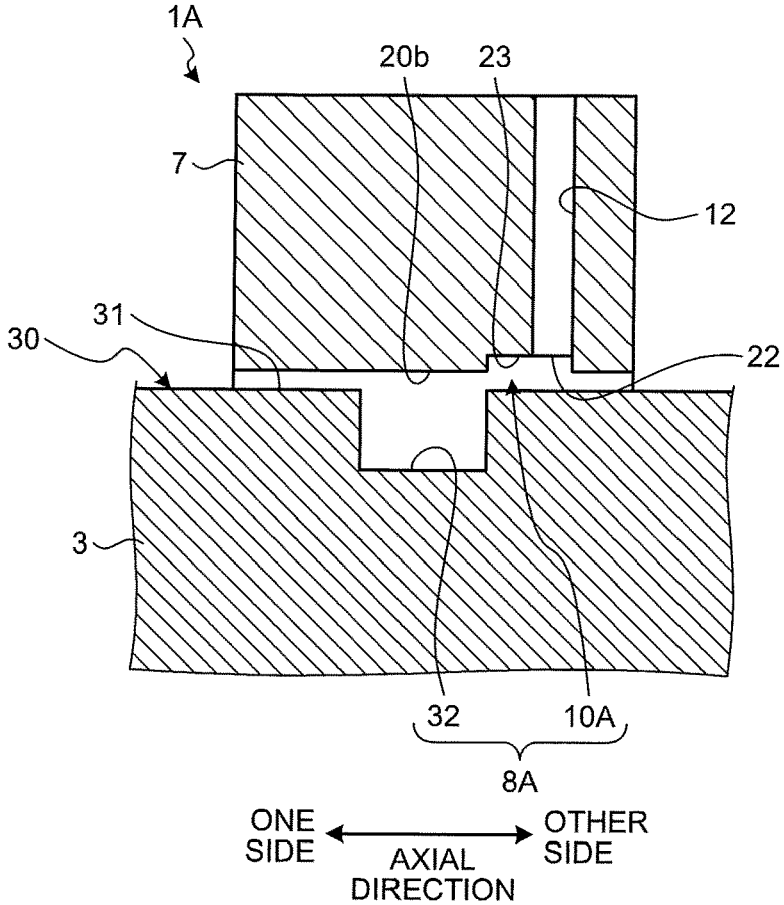
FIG. 6 is a cross-sectional view illustrating a cross section taken along the line A-A in FIG. 5.

As illustrated in FIG. 6, a connection oil passage 8A is configured to include the oil groove 32 and the throttle portion 10A. The oil groove 32 is formed in a portion of an outer circumferential surface 31 facing the bearing surface 20*b*, and has a predetermined width in the axial direction. The inlet port 22 is opened at a position different from the axial position of the oil groove 32.

The throttle portion 10A is a portion of the connection oil passage 8A where a flow path is formed between the oil groove 32 and the inlet port 22. That is, the oil outlet port 21 and the inlet port 22 are disposed at a position where axial positions thereof overlap and circumferential positions thereof are different.

Specifically, the throttle portion 10A is formed by a radial gap between an adjustment groove 23 formed on the bearing surface 20*b* and the outer circumferential surface 31 of the cam journal 3. The adjustment groove 23 is a groove portion for adjusting the flow rate of lubricating oil distributed (supplied) toward the inlet port 22, and is formed in a shallow groove. For example, a depth of the adjustment groove 23 is formed to be shallower than a depth of the oil groove 32. Further, the adjustment groove 23 is provided at a position not facing the oil groove 32 in the radial direction. That is, the axial position of the adjustment groove 23 is a position different from the axial position of the oil groove 32. As a result, the oil passage formed by the radial gap between a bottom surface of the adjustment groove 23 and the outer circumferential surface 31 is a narrower flow path than an oil passage formed by a radial gap between a bottom surface of the oil groove 32 and the bearing surface 20*b*.

In addition, a second oil passage 12 is formed in a shape which is inclined with respect to a height direction. By increasing an inclination angle, the second oil passage 12 can be formed at a position where a surface pressure acting on the cam cap 7 from the cam journal 3 is low. The second oil passage 12 is provided in the portion of the cam cap 7 where the surface pressure from the cam journal 3 is low, thereby increasing durability.

As illustrated in FIG. 7, the adjustment groove 23 is formed on the bearing surface 20*b* of the cam cap 7. More specifically, the inlet port 22 and the adjustment groove 23 are disposed at a position where the circumferential positions overlap. The adjustment groove 23 is formed in a part of the bearing surface 20*b* in the circumferential direction. In this way, when the flow rate of the lubricating oil is small in a cross-sectional area of the oil passage formed by the radial gap between the bearing surface 20*b* of the cam cap 7 and the outer circumferential surface 31 of the cam journal 3, it is possible to increase the flow rate of lubricating oil flowing into the inlet port 22 by providing the adjustment groove 23 on the bearing surface 20*b*. The inlet port 22 is opened at a position of the outer circumferential surface 31 of the cam journal 3 facing, in the radial direction, the portion where the oil groove 32 is not provided.

Note that the oil passage formed by the oil groove 32 of the camshaft 30 is provided with a branched oil passage 13 branched from the second oil passage 12. This branched oil passage 13 is connected to a downstream side of the oil passage including the oil groove 32 and supplies the lubricating oil to a supply destination different from the cam shower 4. Further, in this modification, the oil outlet port 21 and the inlet port 22 may be at least disposed at a position where the axial positions are different, and may not necessarily be disposed at a position where the circumferential positions are different.

Second Embodiment

Figure 8:
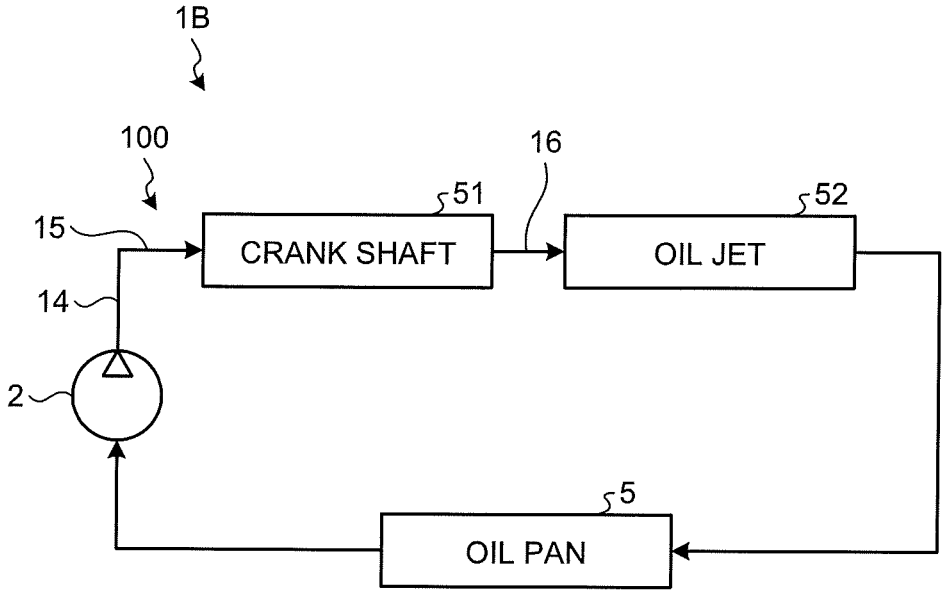
FIG. 8 is a configuration diagram illustrating a case where a lubricating oil supply structure according to a second embodiment is applied to a lubricating device of an internal combustion engine.
Figure 9:
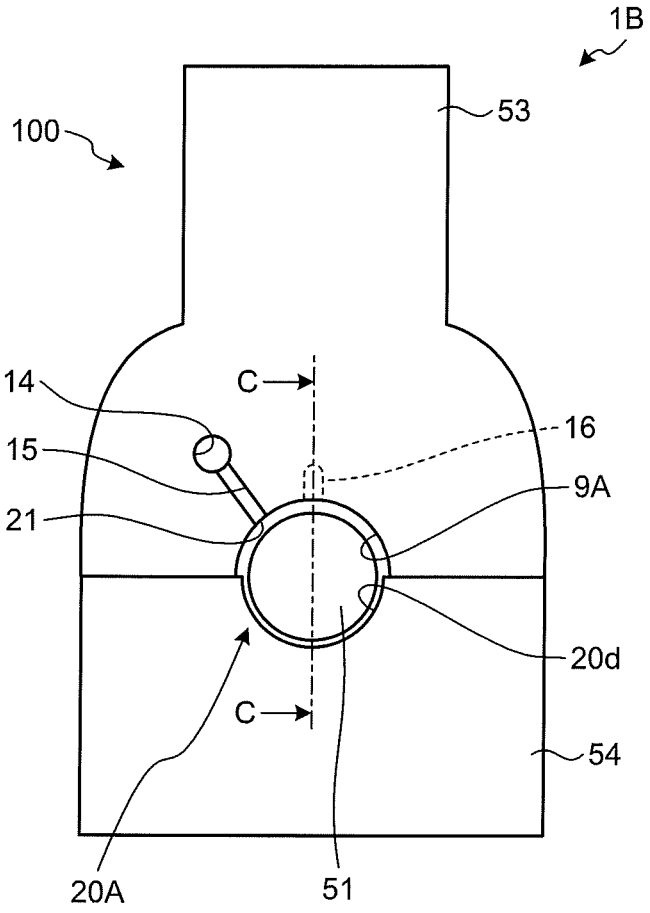
FIG. 9 is a diagram schematically illustrating a configuration of the lubricating oil supply structure according to the second embodiment.
Figure 10:
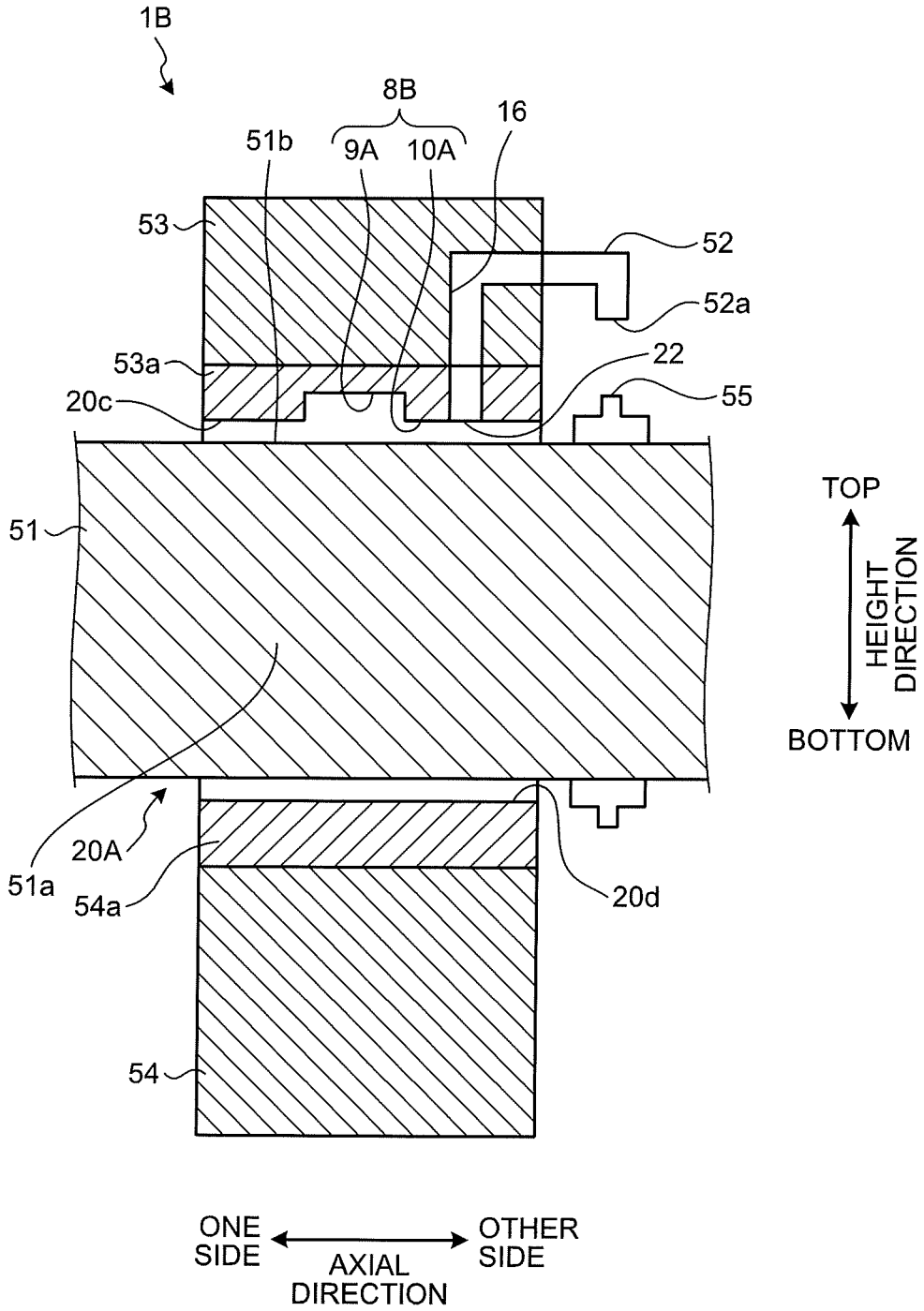
FIG. 10 is a diagram schematically illustrating a configuration of the lubricating oil supply structure according to the second embodiment.

FIG. 8 is a configuration diagram illustrating a case where a lubricating oil supply structure according to a second embodiment is applied to a lubricating device of an internal combustion engine. FIG. 9 is a diagram schematically illustrating a configuration of the lubricating oil supply structure according to the second embodiment. FIG. 10 is a diagram schematically illustrating the configuration of the lubricating oil supply structure according to the second embodiment. FIG. 10 schematically illustrates a cross-sectional view taken along the line C-C of FIG. 9. Note that in the description of the second embodiment, the description of the same configuration as that of the first embodiment described above is omitted, and reference numerals thereof are referred to.

As illustrated in FIG. 8, in a lubricating device 100 in the second embodiment, oil pumped from an oil pump 2 is supplied to a crank shaft 51 and an oil jet 52. A lubricating oil supply destination includes the crank shaft 51 and the oil jet 52. In this circulation route, the oil jet 52 is disposed on a downstream side of the crank shaft 51. The oil jet 52 is a portion that requires a small amount of lubricating oil.

The oil pump 2 discharges lubricating oil to a supply oil passage, and supplies the lubricating oil to a main oil gallery 14 communicating with the supply oil passage and a first oil passage 15. The main oil gallery 14 is an oil passage provided in a cylinder block 53 (illustrated in FIG. 9), and distributes the lubricating oil supplied to a plurality of supply destinations. The first oil passage 15 is an oil passage through which the lubricating oil supplied from the oil pump 2 is distributed toward a crank journal 51*a* (illustrated in FIG. 10) of the crank shaft 51. The main oil gallery 14 and the first oil passage 15 communicate with each other, and lubricating oil is supplied from the first oil passage 15 to the crank shaft 51. The lubricating oil supplied to the crank shaft 51 lubricates the crank shaft 51 and then is supplied to the oil jet 52 via a second oil passage 16. The oil jet 52 injects lubricating oil to a sprocket 55 (illustrated in FIG. 10) of a timing chain. The lubricating oil injected from the oil jet 52 is supplied to the sprocket 55 integrally rotating with the crank shaft 51 and then is stored in an oil pan 5 provided under an internal combustion engine.

As illustrated in FIGS. 9 and 10, a lubricating oil supply structure 1B according to the second embodiment is a structure provided around the crank shaft 51, and includes a connection oil passage 8B formed by a gap between the crank shaft 51 and a bearing 20A. The connection oil passage 8B constitutes a flow path that connects between the first oil passage 15 and the second oil passage 16. The lubricating oil is supplied to the oil jet 52 via this connection oil passage 8B. Specifically, a route through which the lubricating oil flows is formed in the order of the main oil gallery 14, the first oil passage 15, the oil outlet port 21, the connection oil passage 8B, the inlet port 22, the second oil passage 16, and the oil jet 52 from an upstream side toward a downstream side.

The first oil passage 15 is an oil passage formed in a cylinder block 53, and the downstream side is connected to the oil outlet port 21. The oil outlet port 21 is an opening formed in the cylinder block 53 and supplies the lubricating oil pumped from the first oil passage 15 to the gap between the crank shaft 51 and the bearing 20A.

The cylinder block 53 which is an upper bearing is provided with a first main bearing 53*a*. A ladder frame 54 which is a lower bearing is provided with a second main bearing 54*a*. The first and second main bearings 53*a* and 54*a* are half-divided cylindrical metals. A bearing surface 20*c* of the first main bearing 53*a* is provided with an oil groove 9A extending in a circumferential direction. On the other hand, a bearing surface 20*d* of the second main bearing 54*a* is not provided with the oil groove. The oil outlet port 21 is opened in the oil groove 9A provided on the bearing surface 20*c* on the cylinder block 53 side. The lubricating oil is supplied from the oil outlet port 21 to the inside of the oil groove 9A.

The connection oil passage 8B is an oil passage through which the lubricating oil is distributed between the oil outlet port 21 and the inlet port 22, and is the oil passage that connects between the first oil passage 15 and the second oil passage 16. The connection oil passage 8B is configured to include the oil groove 9A and a throttle portion 10A. The oil passage formed by the oil groove 9A is an oil passage formed by a gap between a bottom surface of the oil groove 9A and an outer circumferential surface 51*b* of the crank journal 51*a*. The throttle portion 10A is disposed at a position between the inlet port 22 and the oil groove 9A in a circumferential direction of the bearing 20A. That is, the oil outlet port 21 and the inlet port 22 are disposed at a position where axial positions overlap and circumferential positions are different.

The throttle portion 10A is an oil passage formed by a gap between the bearing surface 20*c* on the cylinder block 53 side which is an upper bearing and the outer circumferential surface 51*b* of the crank journal 51*a*. The throttle portion 10A has a structure that suppresses a distribution (flow) of lubricating oil flowing from the oil outlet port 21 into the inlet port 22. As illustrated in FIG. 10, a radial gap formed by the throttle portion 10A is formed to be narrower than a radial gap formed by the oil groove 9A. Therefore, the throttle portion 10A functions as a portion where a cross-sectional area of the oil passage is more reduced and a flow rate of lubricating oil is more reduced, as compared with the portion where the oil groove 9A is provided.

Further, since the connection oil passage 8B is formed by a gap between the bearing surface 20*c* on the cylinder block 53 side and the shaft surface, the connection oil passage 8B has a foreign matter discharging and embedding function. Therefore, when diameters of the first oil passage 15 and the second oil passage 16 are formed to be approximately ϕ0.2 to 1.5 mm capable of suppressing foreign matter clogging, the throttle portion 10A provided in the connection oil passage 8B is formed in a flow path (narrow flow path) narrower than the minimum diameter of 1.2 mm. For example, the throttle portion 10A is an oil passage formed by a gap of several tens of μm.

The inlet port 22 is an opening through which the lubricating oil existing between the outer circumferential surface 51*b* of the crank journal 51*a* and the bearing surface of the bearing 20A is introduced into the second oil passage 16. The inlet port 22 is opened on the bearing surface 20*c* of the first main bearing 53*a* on the cylinder block 53 side. More specifically, the inlet port 22 is opened in the portion of the bearing surface 20*c* of the first main bearing 53*a* where the oil groove 9A is not formed. That is, the axial position of the inlet port 22 is a position different from the axial position of the oil groove 9A. This inlet port 22 enables lubricating oil to be distributed toward a supply destination different from the crank journal 51*a*.

The second oil passage 16 is an oil passage formed in the cylinder block 53, and the upstream side is connected to the inlet port 22. The oil jet 52 is connected to the downstream side of the second oil passage 16. The oil jet 52 is disposed above the sprocket 55 of the timing chain. The oil jet 52 is provided with a supply port 52*a* through which the lubricating oil is injected. The supply port 52*a* is disposed above the sprocket 55 and is opened downward. The lubricating oil introduced from the inlet port 22 into the second oil passage 16 is injected from the supply port 52*a* of the oil jet 52 and supplied to the sprocket 55.

As described above, in the second embodiment, the lubricating oil can be supplied to the oil jet 52 via the connection oil passage 8B formed by the gap between the bearing surface of the bearing 20A and the outer circumferential surface 51*b* of the crank journal 51*a*. Further, since the gap between the bearing 20A and the crank shaft 51 has the foreign matter discharging and embedding function, the foreign matter clogging can be suppressed even in the narrow flow path, unlike a related-art oil passage. Therefore, it is possible to reduce the flow rate of lubricating oil supplied to the oil jet 52 which is a supply destination, requiring a small amount of lubricating oil, by providing the throttle portion 10A in the connection oil passage 8B.

In addition, in the second embodiment, the connection oil passage 8B formed by the gap between the bearing 20A and the crank journal 51*a* is provided on the upstream side of the oil jet 52, and the throttle portion 10A may be formed in a part of the connection oil passage 8B. An example of the related-art structure is a structure in which the inlet port 22 of the second oil passage 16 is opened in the oil groove 9A of the first main bearing 53*a*. Compared with the related-art structure, in the second embodiment, the position where the inlet port 22 is provided is only changed from the inside of the oil groove 9A to the portion where the oil groove 9A is not provided, so that the manufacturing cost can be suppressed. Therefore, according to the second embodiment, the structure is simple, and the flow rate of the lubricating oil can be reduced while suppressing the foreign matter clogging.

In addition, since the flow of the lubricating oil can be suppressed by the throttle portion 10A and the minimum required lubricating oil can be supplied to the oil jet 52, the capacity of the oil pump 2 can be reduced and the unnecessary work can be reduced. Therefore, according to the second embodiment, the surplus of the oil pump capability can be reduced while considering a decrease in a supply pressure to a hydraulic device due to air bubbles, and the capacity of the oil pump 2 can be further reduced.

Note that in the second embodiment, the structure in which the connection oil passage 8B includes the oil groove 9A is described, but the present disclosure is not limited thereto. That is, the connection oil passage 8B may have a structure including the throttle portion 10A formed by the gap between the bearing surface and the outer circumferential surface of the shaft, and may not necessarily include the oil groove 9A. In short, the oil passage structure that passes through the bearing 20A which is the portion having the foreign matter discharging and embedding function may be the lubricating oil supply structure 1B including the connection oil passage 8B in which the oil groove 9A is not provided.

In the present disclosure, since the connection oil passage that connects between the first oil passage and the second oil passage is formed by the gap between the bearing and the shaft, it is possible to suppress foreign matter from flowing into the second oil passage from the connection oil passage and since the connection oil passage has the throttle portion, it is possible to reduce the flow rate of lubricating oil supplied to the second oil passage.

According to an embodiment, a flow rate of lubricating oil toward an inlet port can be reduced by a throttle portion, and the lubricating oil is supplied from an oil outlet port opening inside an oil groove on a bearing side to the oil groove, so the amount of lubricating oil required to lubricate the bearing can be secured in the oil groove.

According to an embodiment, a flow rate of lubricating oil toward the inlet port can be reduced by the throttle portion, and the lubricating oil is supplied from the oil outlet port on the bearing side toward the oil groove on a shaft side, so the amount of lubricating oil required to lubricate the bearing can be secured in the oil groove.

According to an embodiment, the structure becomes simple and the degree of freedom in design for the disposition of the oil outlet port and the inlet port can be increased.

According to an embodiment, a lubricating oil supply structure can be applied to a lubricating device of an internal combustion engine, and a flow rate of lubricating oil supplied to a cam shower can be reduced by disposing the cam shower on a downstream side of a cam journal.

According to an embodiment, a lubricating oil supply structure can be applied to a lubricating device of an internal combustion engine, and lubricating oil supplied to a crank journal can be supplied to a sprocket via a connection oil passage. As a result, it is possible to reduce the flow rate of lubricating oil supplied to the sprocket.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricating oil supply structure, comprising:

a shaft;

a bearing having a bearing surface on which an oil groove that extends along a circumferential direction of the bearing, is formed, the bearing supports the shaft and has an oil supply port that is formed on the oil grove, through which a lubricating oil is supplied to between the shaft and the bearing, and an oil introduction port that is formed on the bearing surface and on an area other than an area where the oil groove is formed, through which the lubricating oil between the shaft and the bearing is introduced;

a first oil passage, which is connected to the oil supply port and distributes the lubricating oil from an oil pump toward the oil supply port;

a second oil passage, which is connected to the oil introduction port and supplies the lubricating oil introduced through the oil introduction port to a supply destination other than the bearing;

a connection oil passage, which is formed by a gap between the bearing and the shaft and connects between the first oil passage and the second oil passage; and a throttle portion, formed on a part of the connection oil passage, configured to suppress a flow of the lubricating oil from the oil supply port toward the oil introduction port, the throttle portion being formed by a gap which is narrower than a gap between a part where the oil groove where the throttle portion is not formed and the shaft, wherein the connection oil passage passes through the oil groove and the throttle portion.

2. The lubricating oil supply structure according to claim 1, wherein an oil outlet port and an inlet port are formed on respective positions, which overlap with each other in an axial direction and differs from each other in a circumferential direction of the lubricating oil supply structure.

3. The lubricating oil supply structure according to claim 1, wherein an oil outlet port and an inlet port are formed on respective positions, which differs from each other in an axial direction of the lubricating oil supply structure.

4. The lubricating oil supply structure according to claim 1, wherein the shaft is a camshaft provided in an internal combustion engine, the portion supported on the bearing is a cam journal of the camshaft, and the supply destination is a cam shower which drops the lubricating oil to a cam lobe of the camshaft.

5. The lubricating oil supply structure according to claim 1, wherein the shaft is a crank shaft of an internal combustion engine, the portion supported on the bearing is a crank journal of the crank shaft, and the supply destination is a sprocket integrally rotating with the crank shaft.

6. A lubricating oil supply structure, comprising:

a shaft having an outer circumferential surface;

a bearing, which supports the shaft and has an oil supply port, through which a lubricating oil is supplied to between the shaft and the bearing, and an oil introduction port, through which the lubricating oil between the shaft and the bearing is introduced;

a first oil passage, which is connected to the oil supply port and distributes the lubricating oil from an oil pump toward the oil supply port;

a second oil passage, which is connected to the oil introduction port and supplies the lubricating oil introduced through the oil introduction port to a supply destination other than the bearing;

a connection oil passage, which is formed by a gap between the bearing and the shaft and connects between the first oil passage and the second oil passage; and a throttle portion, formed on a part of the connection oil passage, configured to suppress a flow of the lubricating oil from the oil supply port toward the oil introduction port, wherein:

an oil groove, extending along a circumferential direction of the shaft, is formed on a part of the outer circumferential surface, the part being supported by the bearing, the oil supply port is formed on the bearing surface of the bearing and on a position facing the oil groove in a radial direction of the lubricating oil supply structure, the oil introduction port is formed on the bearing surface and on a position which does not face the oil groove in the radial direction, and the throttle portion is formed by a gap which is narrower than a gap between a part of the oil groove where the throttle portion is not formed and the bearing surface.

7. The lubricating oil supply structure according to claim 6, wherein an oil outlet port and an inlet port are formed on respective positions, which overlap with each other in an axial direction and differs from each other in a circumferential direction of the lubricating oil supply structure.

8. The lubricating oil supply structure according to claim 6, wherein an oil outlet port and an inlet port are formed on respective positions, which differs from each other in an axial direction of the lubricating oil supply structure.

9. The lubricating oil supply structure according to claim 6, wherein the shaft is a camshaft provided in an internal combustion engine, the portion supported on the bearing is a cam journal of the camshaft, and the supply destination is a cam shower which drops the lubricating oil to a cam lobe of the camshaft.

10. The lubricating oil supply structure according to claim 6, wherein the shaft is a crank shaft of an internal combustion engine, the portion supported on the bearing is a crank journal of the crank shaft, and the supply destination is a sprocket integrally rotating with the crank shaft.

* * * * *